US008403618B2

(12) United States Patent
Prentice et al.

(10) Patent No.: US 8,403,618 B2
(45) Date of Patent: Mar. 26, 2013

(54) LIFT TRUCK LOAD HANDLER

(75) Inventors: Glenn Prentice, Milwaukie, OR (US); Patrick A. Armony, Wilsonville, OR (US); David Petronek, Boring, OR (US)

(73) Assignee: Cascade Corporation, Portland, OR (US)

( * ) Notice: Subject to any disclaimer, the term of this patent is extended or adjusted under 35 U.S.C. 154(b) by 2419 days.

(21) Appl. No.: 11/187,619

(22) Filed: Jul. 22, 2005

(65) Prior Publication Data

US 2006/0115354 A1 Jun. 1, 2006

Related U.S. Application Data

(63) Continuation-in-part of application No. 11/000,783, filed on Nov. 30, 2004, now Pat. No. 7,909,563.

(51) Int. Cl.
*B66F 9/14* (2006.01)

(52) U.S. Cl. ..... 414/667; 414/671

(58) Field of Classification Search ..... 414/664–671
See application file for complete search history.

(56) References Cited

U.S. PATENT DOCUMENTS

| | | | | |
|---|---|---|---|---|
| 3,092,274 | A | | 6/1963 | Harris |
| 3,373,886 | A | * | 3/1968 | Ulinski ..... 414/621 |
| 3,647,255 | A | | 3/1972 | Hale et al. |
| 3,754,673 | A | | 8/1973 | Barda et al. |
| 3,768,367 | A | | 10/1973 | Fuzzell |
| 3,851,779 | A | | 12/1974 | Crawford |
| 3,889,833 | A | | 6/1975 | Thomas |
| 3,892,079 | A | | 7/1975 | Hirano et al. |
| 4,002,256 | A | | 1/1977 | Kroboth |
| 4,125,199 | A | | 11/1978 | Abels et al. |
| 4,161,256 | A | | 7/1979 | Seaberg |
| 4,286,692 | A | | 9/1981 | Bauer et al. |
| 4,303,269 | A | | 12/1981 | Faughnan |
| 4,381,166 | A | | 4/1983 | Smart |
| 4,381,872 | A | | 5/1983 | Hahn |
| 4,392,772 | A | | 7/1983 | Reeves |
| 4,395,188 | A | | 7/1983 | Kaup |
| 4,406,575 | A | | 9/1983 | Gaibler |

(Continued)

FOREIGN PATENT DOCUMENTS

| | | |
|---|---|---|
| DE | GM 74 39 361 | 3/1975 |
| DE | 28 35 031 | 2/1980 |

(Continued)

OTHER PUBLICATIONS

Office Action dated Mar. 27, 2009 in corresponding Canadian patent application (now Canadian Patent No. 2,586,069).

(Continued)

*Primary Examiner* — Saul Rodriguez
*Assistant Examiner* — Jonathan Snelting
(74) *Attorney, Agent, or Firm* — Chernoff Vilhauer McClung & Stenzel, LLP

(57) ABSTRACT

A fork positioner, usable alternatively either as an attachment to an existing load-lifting carriage with forks, or as part of the original equipment of a load-lifting carriage, has a pair of elongate hydraulic piston and cylinder assemblies mountable in an interconnected parallel relationship between an upper transverse fork-supporting member and a lower transverse member of the carriage. Each of a pair of fork-positioning guide members has a fork-engagement surface movable by a respective piston and cylinder assembly and connectable thereto so that the fork-engaging surfaces face substantially perpendicularly away from an imaginary plane containing the respective longitudinal axes of the piston and cylinder assemblies. An exemplary carriage mounting the fork positioner is also disclosed, together with a wireless hydraulic function control system for use with the fork positioner or other multi-function load handlers.

18 Claims, 10 Drawing Sheets

U.S. PATENT DOCUMENTS

| | | | | | |
|---|---|---|---|---|---|
| 4,526,413 | A | | 7/1985 | Williams | |
| 4,533,290 | A | | 8/1985 | Hackauf | |
| 4,588,345 | A | | 5/1986 | Anttila | |
| 4,667,736 | A | | 5/1987 | Rumbaugh et al. | |
| 4,714,399 | A | | 12/1987 | Olson | |
| 4,756,661 | A | | 7/1988 | Smart | |
| 4,902,190 | A | | 2/1990 | House | |
| 5,033,934 | A | | 7/1991 | Emilio | |
| 5,052,882 | A | * | 10/1991 | Blau et al. | 414/667 |
| 5,096,363 | A | | 3/1992 | Weinert et al. | |
| 5,139,385 | A | * | 8/1992 | Chase et al. | 414/667 |
| 5,335,955 | A | | 8/1994 | Pekka et al. | |
| 5,336,039 | A | | 8/1994 | House | |
| 5,417,464 | A | | 5/1995 | Seaberg et al. | |
| 5,443,294 | A | | 8/1995 | Prinz et al. | |
| 5,604,715 | A | | 2/1997 | Aman et al. | |
| 5,653,489 | A | | 8/1997 | Fandrich et al. | |
| 5,746,564 | A | | 5/1998 | McPherson | |
| 5,807,060 | A | | 9/1998 | Hamlik | |
| 5,897,596 | A | * | 4/1999 | Kabune et al. | 701/29 |
| 5,927,932 | A | | 7/1999 | Seaberg | |
| 5,957,213 | A | * | 9/1999 | Loraas et al. | 172/2 |
| 6,112,612 | A | * | 9/2000 | Seksaria et al. | 74/471 XY |
| 6,279,686 | B1 | | 8/2001 | Kaup | |
| 6,332,098 | B2 | | 12/2001 | Ross et al. | |
| 6,354,782 | B1 | | 3/2002 | Barry | |
| 6,390,763 | B1 | | 5/2002 | Prentice | |
| 6,413,185 | B1 | * | 7/2002 | Baginski et al. | 475/208 |
| 6,439,826 | B1 | | 8/2002 | Jordan et al. | |
| 6,662,881 | B2 | | 12/2003 | Domann | |
| 6,672,823 | B2 | | 1/2004 | Henning | |
| 6,851,915 | B2 | * | 2/2005 | Warner et al. | 414/667 |
| 7,121,457 | B2 | | 10/2006 | Michal, III | |
| 2001/0039464 | A1 | | 11/2001 | Hackauf | |
| 2001/0041948 | A1 | | 11/2001 | Ross et al. | |
| 2002/0003221 | A1 | * | 1/2002 | Koyama et al. | 251/30.01 |
| 2004/0069497 | A1 | * | 4/2004 | Jones et al. | 166/379 |
| 2004/0102869 | A1 | | 5/2004 | Andersen et al. | |
| 2004/0102870 | A1 | | 5/2004 | Andersen et al. | |

FOREIGN PATENT DOCUMENTS

| | | | |
|---|---|---|---|
| DE | G 83 01 302.4 | | 11/1983 |
| DE | G 85 01 143.6 | | 3/1985 |
| DE | G 78 36 443.9 | | 12/1987 |
| DE | 34 00 916 | C2 | 3/1988 |
| DE | 36 32 031 | A1 | 4/1988 |
| DE | 36 39 933 | A1 | 6/1988 |
| DE | G 92 02 642.7 | | 4/1992 |
| DE | 40 41 846 | A1 | 6/1992 |
| DE | 35 15 524 | C2 | 12/1994 |
| DE | 196 29 194 | A1 | 1/1997 |
| DE | 101 09 851 | A1 | 9/2001 |
| GB | 2 030 542 | A | 4/1980 |
| JP | 53-61982 | | 5/1978 |
| JP | 53-79673 | | 7/1978 |
| JP | 54-120075 | | 8/1979 |
| JP | 56-121095 | | 9/1981 |
| JP | 56-140595 | | 10/1981 |
| JP | 56-144096 | U | 10/1981 |
| JP | 56-144098 | | 10/1981 |
| JP | 59-172399 | | 9/1984 |
| JP | 61-132397 | | 8/1986 |
| JP | S62-89295 | | 6/1987 |
| JP | 62-235197 | A | 10/1987 |
| JP | S62-259997 | | 11/1987 |
| JP | 2095698 | | 4/1990 |
| JP | 2138094 | | 5/1990 |
| JP | 2276799 | | 11/1990 |
| JP | 3244886 | | 10/1991 |
| JP | 2561847 | | 10/1997 |
| JP | 2000-219499 | A | 8/2000 |
| JP | 2002-321899 | A | 11/2002 |
| JP | 2003285682 | | 10/2003 |
| WO | WO82/00997 | | 4/1982 |
| WO | WO92/21606 | | 12/1992 |
| WO | WO2004/007338 | A1 | 1/2004 |

OTHER PUBLICATIONS

Office Action dated Oct. 4, 2010 in corresponding Japanese patent application No. 2007-544343.

International Search Report dated Oct. 25, 2006 in corresponding PCT patent application No. PCT/US05/36978.

* cited by examiner

LIFT TRUCK LOAD HANDLER

This is a continuation-in-part of application Ser. No. 11/000,783 filed Nov. 30, 2004 now U.S. Pat. No. 7,909,563.

BACKGROUND OF THE INVENTION

This invention relates to load handlers which mount on lift truck carriages. In one aspect, the invention relates particularly to a load handler having a fork positioner which can be attached to an existing lift truck carriage, or incorporated as original equipment in a newly-manufactured carriage. In a separate aspect, the invention relates to a wireless fluid power function selector for multifunction load handlers of different types, which may include fork positioners, push-pull attachments, load clamps or other types of load manipulators.

Fork positioners actuated by pairs of hydraulic cylinders, motor-driven screws, or the like represent one type of load handler used extensively on fork-supporting lift truck carriages. Most of these fork positioners are furnished as integral components of a carriage, often in combination with a side-shifting function which enables the carriage to be moved transversely so as to side-shift the forks in unison. Some detachably-mountable fork positioners have been provided in the past, such as those shown in U.S. Pat. Nos. 4,756,661, 4,902,190 and 6,672,823, to enable existing lift truck carriages without fork-positioning capability to be provided with such capability. However such detachably-mounted side-shifters have in the past increased the dimensions of the lift truck carriage, either horizontally as shown in U.S. Pat. No. 4,756,661 which reduces the load-carrying capacity of a counterbalanced lift truck by moving the load forward, or vertically as shown in U.S. Pat. Nos. 4,902,190 and 6,672,823 which impairs the lift truck operator's visibility over the top of the carriage.

Many types of load handlers have multiple separately-controllable fluid power functions. Most of these functions require bidirectional, reversible actuation. Examples of such load handlers include side-shifting fork positioners, side-shifting push-pull attachments, side-shifting and/or rotational load clamps having either parallel sliding clamp arms or pivoting clamp arms, and other types of fluid power-actuated multi-function load handlers. Normally, the foregoing types of load handlers are mounted on a load carriage which is selectively raised and lowered on a mast of an industrial lift truck. Multiple fluid control valves are often provided in the lift truck operator's compartment to separately regulate each of the multiple fluid power functions of the load handler. In such cases, four or even six hydraulic lines must communicate between the lift truck and the load handler to operate the multiple bidirectional functions. To avoid the necessity for more than two hydraulic lines, it has long been common to provide only a single control valve in the operator's compartment connected to a single pair of hydraulic lines extending between the lift truck and a multi-function load handler. In such case, one or more solenoid valves are mounted on the load handler controlled by electrical wires routed between the lift truck and the load handler so that the operator can electrically select which load handler function will be actuated by the single pair of hydraulic lines. However, routing the electrical wires over the lift truck mast to a vertically movable load handler requires exposure of the wires and their connectors to significant hazards, wear and deterioration, resulting in breakage, short-circuiting, corrosion and other problems which require relatively frequent replacement and downtime.

Moreover, lift truck electrical systems range from twelve to ninety-six volts, requiring a variety of special coils for the solenoid valves.

In other types of industrial work equipment, it has been known to control one or more remote solenoid valves by means of a radio transmitter controlled by the operator, which controls the solenoid valve(s) by sending signals to a remote receiver, as shown for example in U.S. Pat. Nos. 3,647,255, 3,768,367, 3,892,079, 4,381,872, 4,526,413, and 6,662,881. However, these control systems are generally not compatible with the special requirements of lift truck-mounted load handlers with respect to minimizing the size and electrical power demands of such systems, and maximizing the safety thereof. For example, their lack of two-way wireless communication between the transmitter and receiver limits the functionality, reliability and safety of their working components.

BRIEF SUMMARY OF THE INVENTION

In one aspect of the invention, a need exists for a highly-compact fork positioner which does not require such increased dimensions, does not significantly impair operator visibility, and is easy to mount on existing lift truck carriages or newly-manufactured carriages.

In a completely separate aspect of the invention, a need exists for wireless control systems for lift truck-mounted load handlers of different types, which systems are especially adapted to satisfy the particular requirements of such load handlers and the counterbalanced lift trucks upon which they are mounted.

The foregoing and other objectives, features, and advantages of the invention will be more readily understood upon consideration of the following detailed description taken in conjunction with the accompanying drawings.

BRIEF DESCRIPTION OF THE SEVERAL DRAWINGS

DETAILED DESCRIPTION OF PREFERRED EMBODIMENTS

Figure 2:
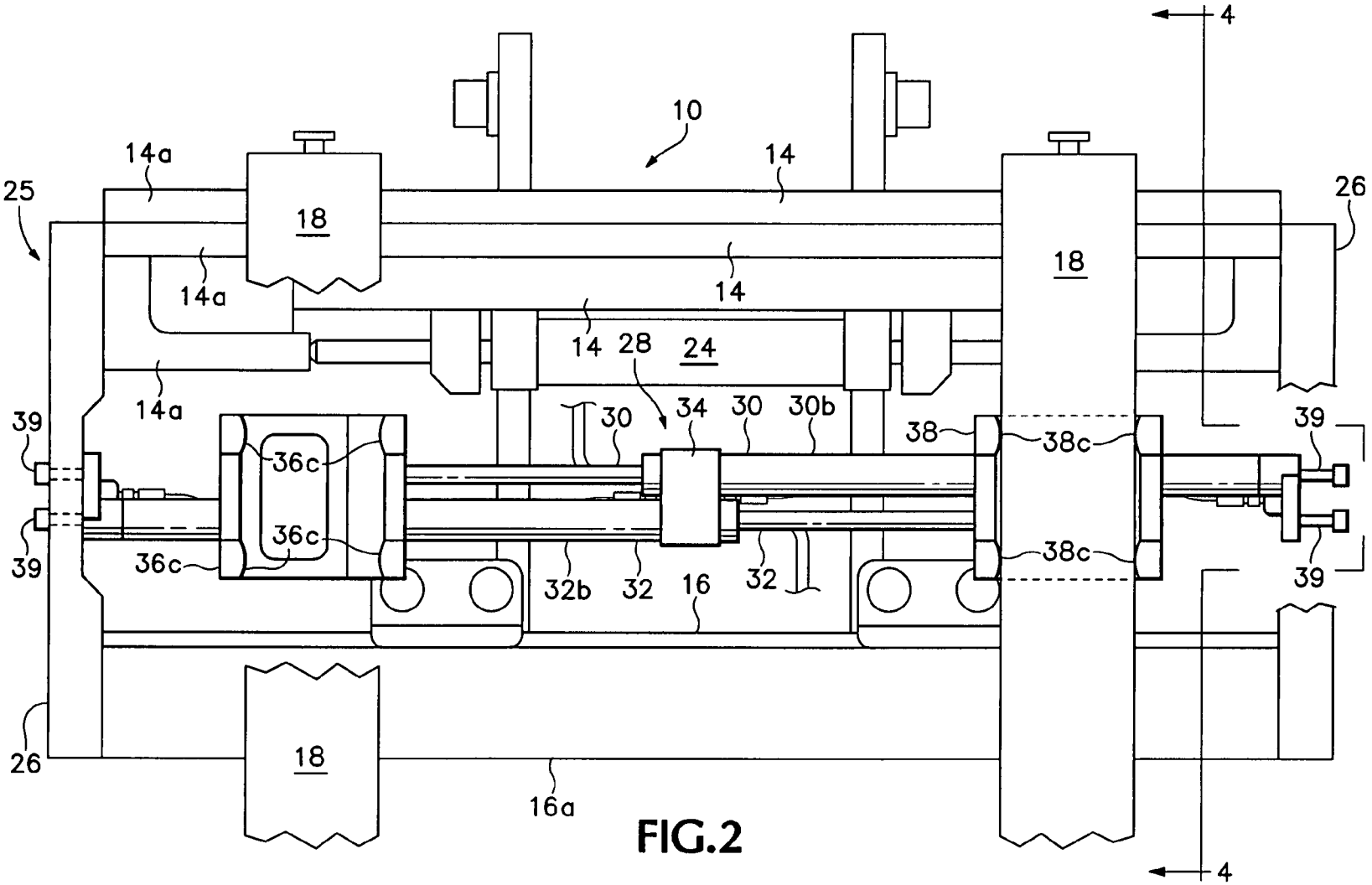
FIG. 2 is a front view of an exemplary side-shifting load-lifting carriage mounting the fork positioner of FIG. 1.
Figure 3:
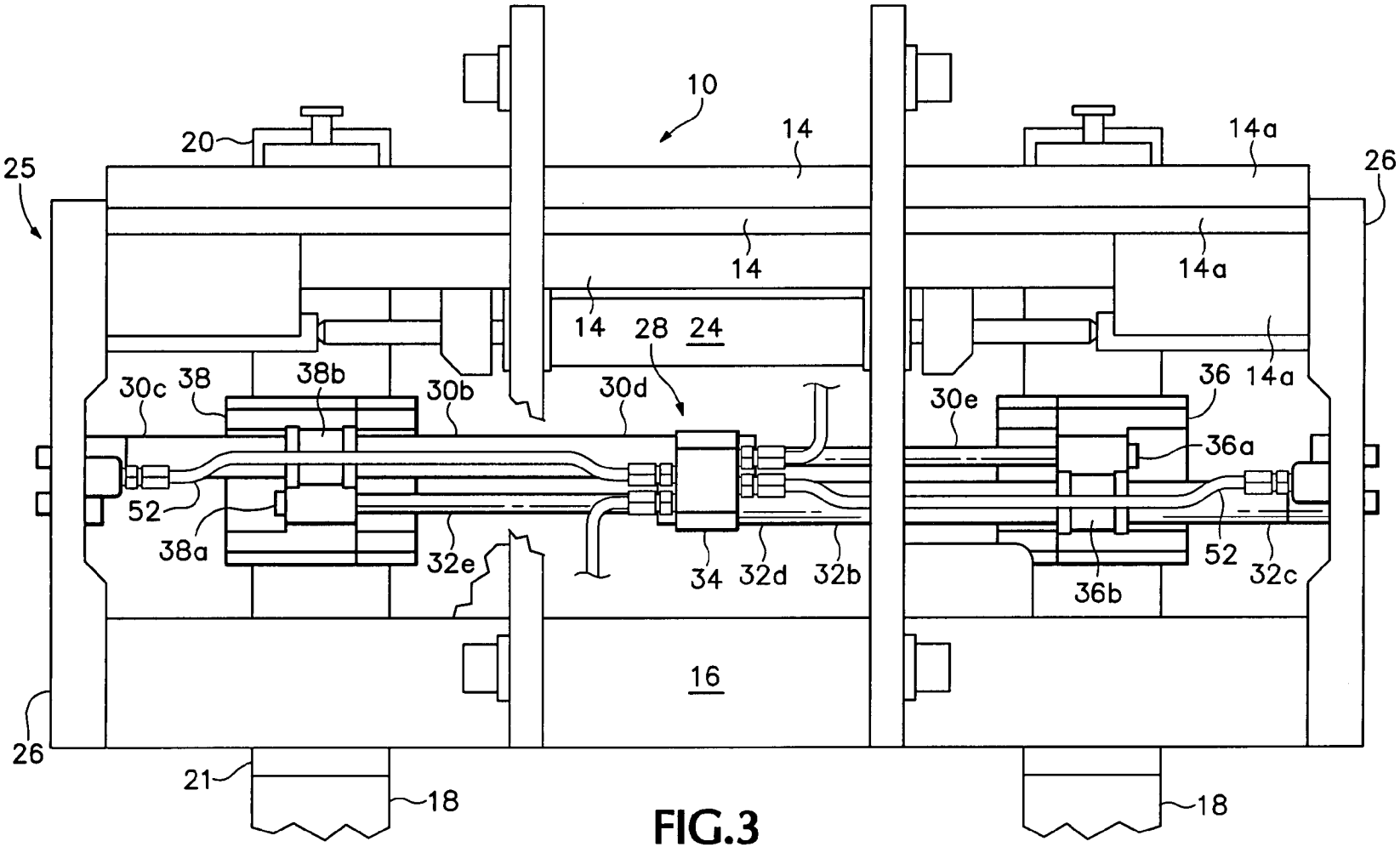
FIG. 3 is a rear view of the carriage of FIG. 2.
Figure 4:
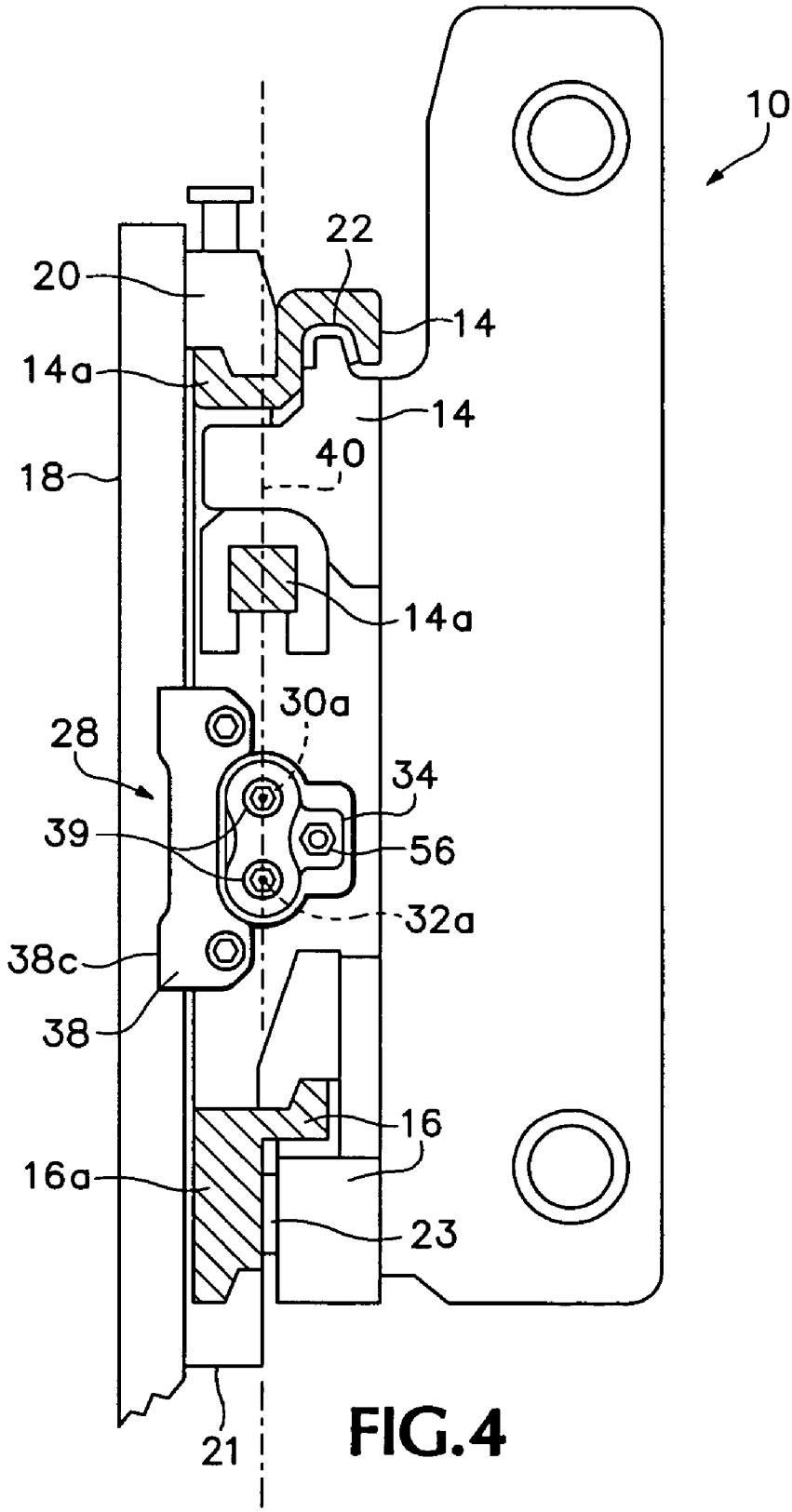
FIG. 4 is a partially sectional side view of the carriage of FIG. 2, taken along line 4-4.

FIGS. 2-4 show an exemplary embodiment of a load-lifting carriage 10 mountable for vertical movement on the mast of an industrial lift truck (not shown). The carriage 10 can be any of numerous different types, usually having an upper transverse fork-supporting member such as 14 and a lower transverse member such as 16 mounting two or more load-lifting forks such as 18 by means of fork hooks 20, 21 (FIG. 4) slidably engaged for transverse movement by hook portions 14*a* and 16*a*, respectively, of upper member 14 and lower member 16. The hook portions 14*a* and 16*a* may be integral parts of the upper member 14 and lower member 16 respectively if the carriage 10 is of a simple standard type. Alternatively, the hook portions 14*a* and 16*a* may be transversely movable relative to the remainder of the upper member 14 and lower member 16 on slide bushings such as 22, 23 (FIG. 4) under the control of a bidirectional side-shifting hydraulic piston and cylinder assembly 24 interacting between a side-shifting frame 25 containing the hook portions 14*a*, 16*a*, and the remainder of the carriage 10. Such a side-shifting frame 25 enables the forks 18 to be moved transversely in unison if desired.

As shown in FIG. 2, the upper hook portion 14*a* and lower hook portion 16*a* of the carriage 10 are joined by respective end members 26 of the frame 25 which side-shift transversely in unison with the hook portions 14*a*, 16*a* and the forks 18. Alternatively, if the carriage 10 is not of the side-shifting type, such end members 26 can join the upper member 14 and lower member 16 of a standard carriage.

If the carriage 10 is of the side-shifting type, its side-shifting piston and cylinder assembly 24 is preferably located immediately beneath, rather than above, the upper member 14 to maximize the operator's visibility over the top of the carriage when the carriage is lowered, and to leave an open space between the side-shifting piston and cylinder assembly 24 and the lower member 16 for enhanced operator visibility through the center of the carriage.

Figure 1:
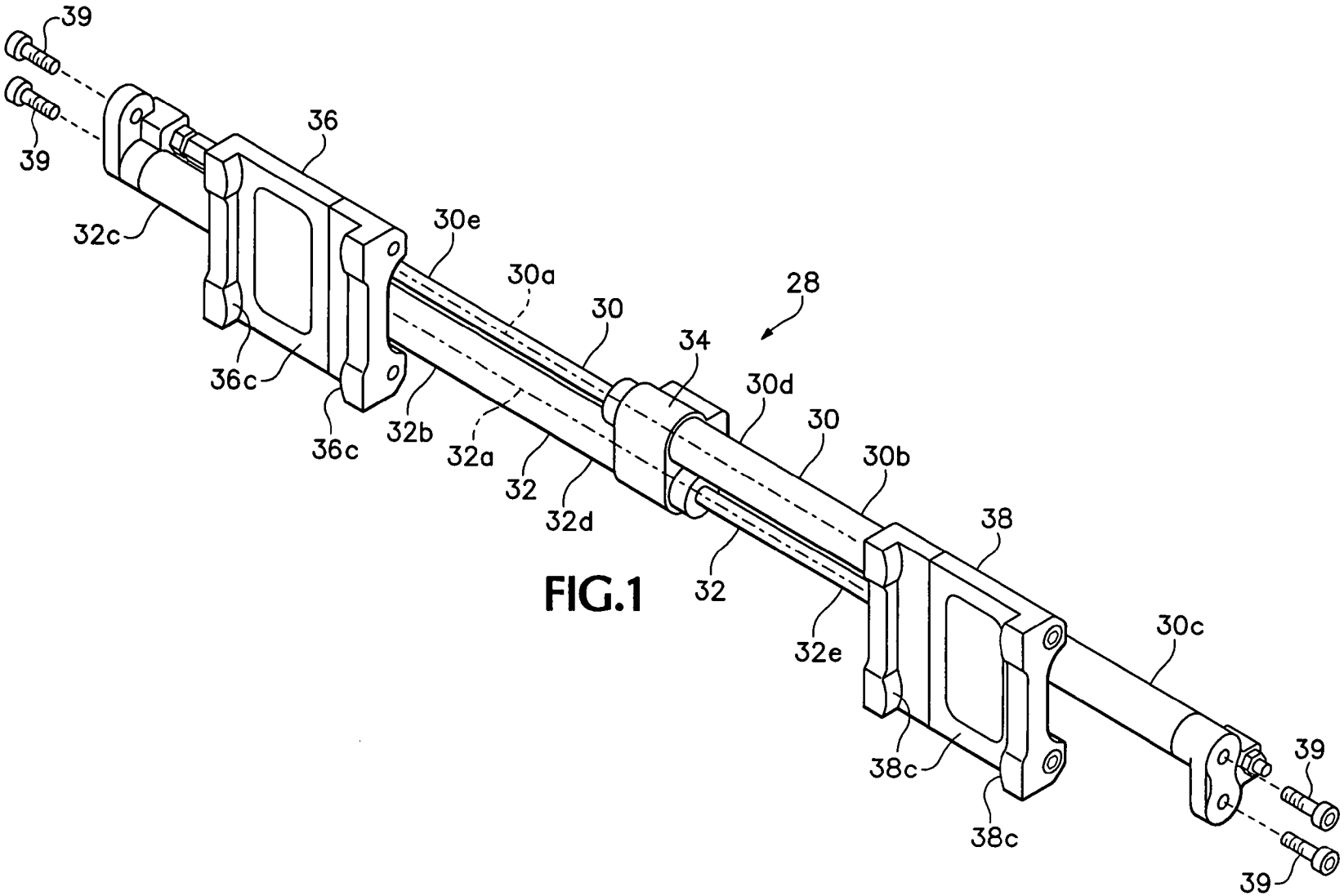
FIG. 1 is a perspective view of an exemplary embodiment of a fork positioner in accordance with the present invention, shown prior to mounting on a load-lifting carriage.

It is often desirable that the carriage 10, whether or not of the side-shifting type, be provided with a fork positioner for enabling the forks 18 to be selectively moved toward or away from each other so as to adjust the transverse spacing between them. To provide this function, a unique fork positioner indicated generally as 28 is disclosed in FIG. 1. The fork positioner 28 may either be conveniently mounted to an existing carriage 10 having no fork-positioning capability or, alternatively, included as part of a carriage 10 as originally manufactured. The fork positioner 28 includes a pair of elongate, bidirectional hydraulic piston and cylinder assemblies 30 and 32 having respective longitudinal axes 30*a*, 32*a* (FIG. 1) and each having a respective cylinder 30*b*, 32*b* with a respective base portion 30*c*, 32*c* at one end and a respective rod end portion 30*d*, 32*d* at the other end from which a respective piston rod 30*e*, 32*e* is extensible along a respective axis 30*a*, 32*a*. A cylinder connector 34 is adapted to threadably interconnect the rod end portion 30*d* of one cylinder rigidly to the rod end portion 32*d* of the other cylinder so that the axes 30*a* and 32*a* are parallel to each other. When the cylinders are interconnected in this manner, the piston rod 30*e*, 32*e* of each of the pair of piston and cylinder assemblies is extensible into longitudinally-overlapping relationship to the cylinder of the other piston and cylinder assembly as shown in FIG. 1.

A pair of fork-positioning guide members 36, 38 each connects to a respective piston rod 30*e*, 32*e* by means of a respective rod connector 36*a*, 38*a* (FIG. 3) while also slidably and guidably engaging the respective cylinder 32*b*, 30*b* of the opposite piston and cylinder assembly by a respective slide bushing 36*b*, 38*b*. This arrangement enables a recessed fork-engagement surface 36*c*, 38*c* (FIG. 1) of each respective guide member to face away from the respective longitudinal axes 30*a*, 32*a* of the piston and cylinder assemblies in a forward direction substantially perpendicular to an imaginary plane 40 (FIG. 4) containing both of the longitudinal axes 30*a* and 32*a*. When the fork positioner 28 is mounted on the carriage 10, the plane 40 also interconnects the upper transverse member 14 and lower transverse member 16 since the piston and cylinder assemblies 30 and 32 are inserted between the members 14 and 16.

When the fork positioner 28 has been mounted to the carriage in an inserted position between the upper member 14 and the lower member 16 as shown in the figures, the piston and cylinder assemblies 30 and 32 can move the guide members 36 and 38 selectively toward and away from each other. Fork positioning force is applied by the guide members 36, 38 to the sides of the respective forks 18 in a substantially direct, nonbinding fashion so that the forks slide easily toward and away from each other along the upper transverse fork-supporting member 14. To maximize this nonbinding force transmission, the fork-engaging surfaces 36*c*, 38*c* are preferably vertically coextensive with at least a major portion of the distance separating the respective longitudinal axes 30*a*, 32*a* of the piston and cylinder assemblies.

In order to provide easy mounting of the fork positioner on the carriage 10 in its inserted position between the upper member 14 and lower member 16, the piston and cylinder assemblies 30 and 32 are preferably mountable on the carriage 10 while interconnected with each other as a unit, for example by the cylinder connector 34 and/or the fork-positioning guide members 36, 38. This unitized insertable fork positioner package requires no unitizing framework other than the piston and cylinder assemblies themselves and, if desired, also the fork-positioning guide members. The resultant rigid, essentially frameless fork positioner unit is thus so compact that it can be mounted in its inserted position centrally on the carriage 10 without significantly impairing the operator's visibility, or altering the dimensions of the carriage 10 in a way that would push the load forwardly and thereby reduce the load-carrying capacity of the lift truck. Moreover, mounting of the fork positioner on the carriage is greatly simplified by the unitized nature of the fork positioner, and by the fact that only the piston and cylinder assemblies 30, 32 must be supportably connected to the carriage 10 since the fork-positioning guide members 36, 38 are supportable by the piston and cylinder assemblies 30, 32 independently of any engagement by either guide member with a fork 18.

One possible easy mounting arrangement for the piston and cylinder assemblies 30 and 32 is to connect the respective base portions 30*c*, 32*c* of the cylinders to respective end members 26 of the carriage 10 by screws 39 as shown in the drawings or by any other convenient means. If an existing carriage 10 has no such end members, they can easily be added to the carriage as part of the assembly process. Alternatively, the piston and cylinder assemblies 30*a*, 32*a* could be more centrally mounted to the carriage 10 by one or more brackets attached to the carriage upper member 14 or 14*a* in a manner which does not significantly impair operator visibility through the center of the carriage.

Figure 5:
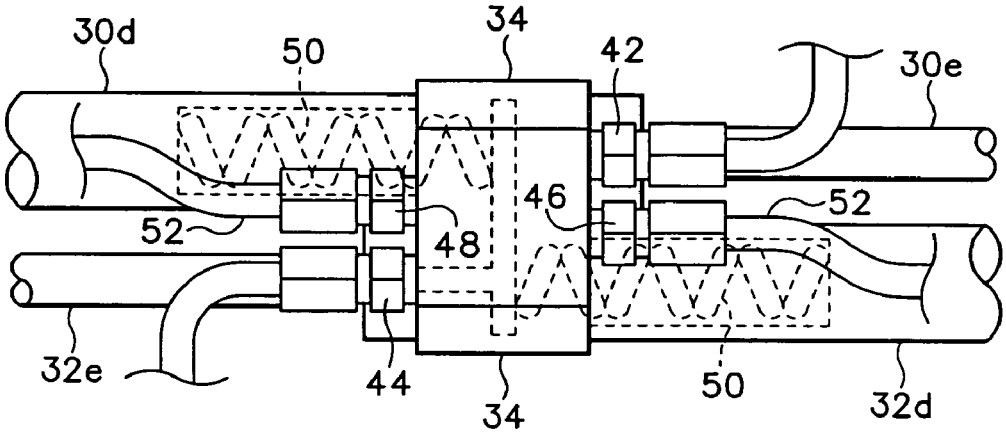
FIG. 5 is an enlarged rear detail view of a center portion of the fork positioner of FIG. 1 showing interior hydraulic conduits.
Figure 6:
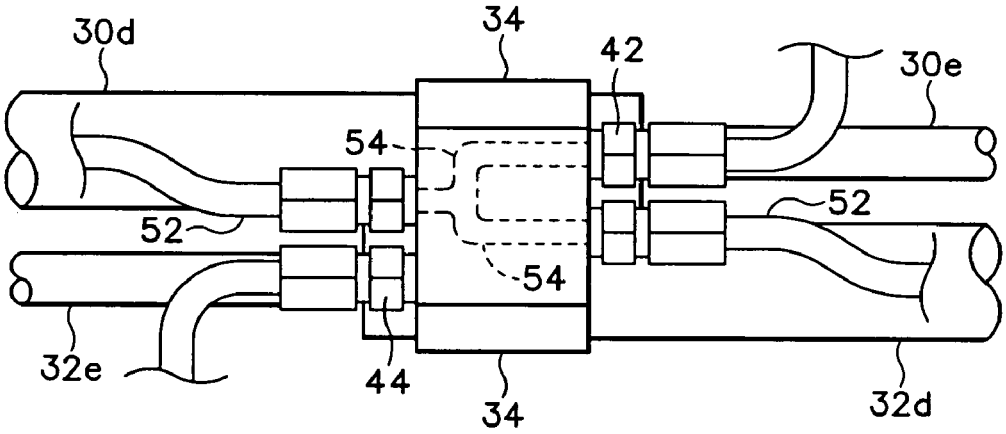
FIG. 6 is an enlarged rear detail view of a center portion of the fork positioner of FIG. 1 showing other interior hydraulic conduits.
Figure 7:
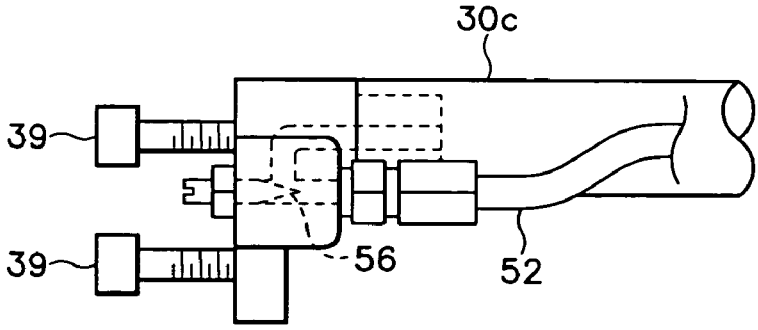
FIG. 7 is an enlarged rear detail view of a base portion of one of the piston and cylinder assemblies of the fork positioner of FIG. 1.

Preferably, the cylinder connector 34 includes one or more hydraulic fluid line connectors 42, 44, 46, 48 communicating with the interiors of the respective cylinders 30*b*, 32*b*. For example, one such connector 44 (FIG. 5) can introduce pressurized fluid simultaneously to the rod end portions 30*d*, 32*d* of the cylinders through internal spiral conduits 50 to retract the piston rods 30*e*, 32*e* simultaneously, while another connector 42 (FIG. 6) communicating with interior conduits 54 and exterior conduits 52 can exhaust hydraulic fluid simultaneously from the base portions 30*c*, 32*c* of the cylinders. Respective conventional flow equalizer valves such as 56 (FIG. 7) in each base portion 30*c*, 32*c* achieve uniform movement of the piston rods. An operator control valve (not shown) can reverse the flows of pressurized fluid and exhaust fluid through connectors 42 and 44 respectively to similarly extend the piston rods.

Although the preferred form of the fork positioner utilizes piston and cylinder assemblies wherein each cylinder 30*b*, 32*b* is connected to the carriage 10 so as to prevent the cylinder's longitudinal movement relative to the carriage, a reversed structure wherein piston rods are connected to the carriage so that their cylinders can move the fork-positioning guide members would also be within the scope of the invention.

Figure 8:
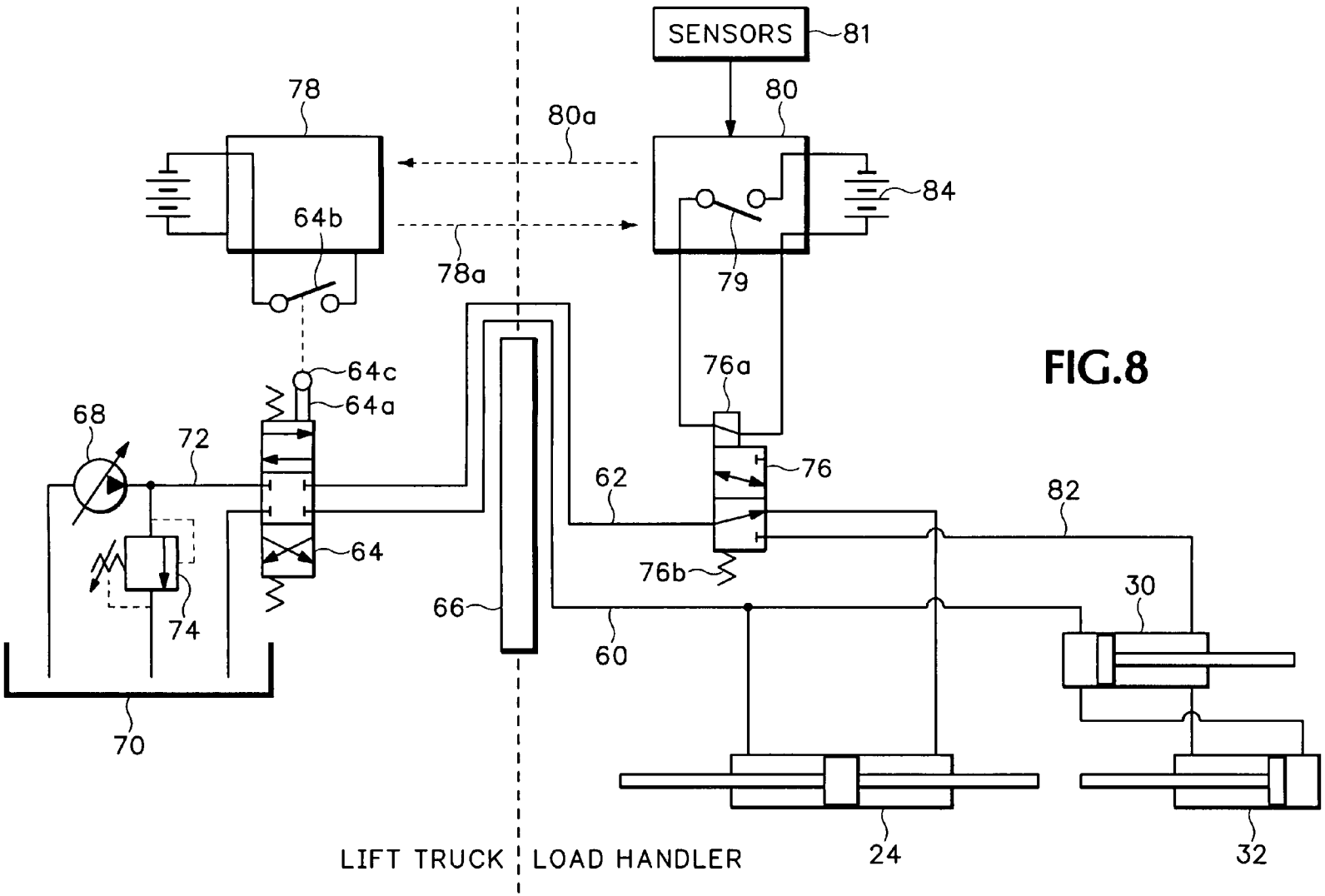
FIG. 8 is a simplified schematic circuit diagram of an exemplary embodiment of a wireless hydraulic control system for the side-shifting fork positioner assembly shown in FIGS. 1-7.

FIG. 8 is a schematic circuit diagram of an exemplary wireless hydraulic control system which may optionally be used for the side-shifting fork-positioner assembly 10, 28 shown in FIGS. 1-7. However a system of this type would also be applicable to a side-shifting load clamp, especially one having parallel sliding clamp arms.

If it is desired to have only a single pair of hydraulic lines 60, 62, and no electrical wires, extending between the lift truck and the load handler 10, 28 of FIGS. 1-7, a hydraulic circuit such as that shown in FIG. 8 will enable the lift truck operator to control the side-shifting function and fork-positioning function separately, utilizing a single control valve 64 on the truck body having a handle 64*a* upon which an electrical switch 64*b* is mounted in the position indicated at 64*c*. The single pair of hydraulic lines 60 and 62 communicate between the lift truck body and the vertically-movable load handler 10, 28 by extending over the lift truck's mast 66, employing a line take up device such as a conventional hose reel to accommodate the variable vertical positions of the load handler relative to the lift truck body.

In the circuit of FIG. 8, the lift truck's engine-driven hydraulic pump 68 pumps hydraulic fluid under pressure from a reservoir 70 through a line 72 to the operator's control valve 64. A relief valve 74 provides protection against excessive pressure in line 72. If the operator manually moves the spool of the valve 64 downwardly from its centered position as seen in FIG. 8, pressurized fluid from line 72 is conducted through line 62 to a solenoid-operated hydraulic selector valve assembly 76 of the load handler. The spool of valve 76 is spring-biased upwardly as seen in FIG. 8, such that the fluid in line 62 operates a first hydraulic actuator and function wherein the fluid is conducted to one end of the side-shifting piston and cylinder assembly 24, causing the piston to shift toward the left as seen in FIG. 8 while fluid is simultaneously exhausted through line 60 and valve 64 to the reservoir 70. Alternatively, if the operator wishes to side-shift in the opposite direction, he manually moves the spool of the valve 64 upwardly as seen in FIG. 8, which conducts pressurized fluid from line 72 to line 60, shifting the piston in the opposite direction while exhausting fluid through line 62 and valve 64 to the reservoir 70.

If, instead of actuating the side-shifting piston and cylinder assembly 24 in one direction or the other, the operator wishes to operate a second hydraulic actuator in the form of fork-positioning cylinders 30 and 32, he controls this second function of the load handler using the same valve 64 while simultaneously manually closing switch 64*b*, such as by a push button at the location 64*c* on the handle 64*a*. Closure of the switch 64*b* causes a radio transceiver 78 on the lift truck body to transmit a radio signal 78*a* to a transceiver 80 located on the load handler 10, 28.

Both transceivers 78 and 80 are programmable to employ any one of thousands of unique matched identity codes, and to transmit these unique codes to each other bidirectionally as radio signals 78*a* and 80*a*, respectively, in a conventional "hand shaking" procedure whereby each transceiver authenticates the identity of the other before enabling transceiver 80 to respond to actuating commands from transceiver 78. Preferably the two transceivers are produced with matched identity codes at the factory. However, in subsequent use it may become necessary to match the identities of two previously unmatched transceivers in the field due to the substitution of a different load handler or transceiver. The transceivers are therefore easily reprogrammable in a conventional manner to enable the user to synchronize the respective identity codes so that the transceivers can interact responsively with each other.

Assuming that the transceivers 78 and 80 have synchronized identity codes, the transceiver 80 will respond to the radio signal 78*a* initiated by the operator's closure of switch 64*b* by closing a solenoid activation switch 79, thereby energizing solenoid 76*a* of function-selector valve 76 and moving its valve spool downwardly as seen in FIG. 8 against the force of spring 76*b*. This movement of the valve 76 places a hydraulic line 82 into communication with line 62. If the operator has moved the spool of valve 64 downwardly, line 82 causes retraction of the fork-positioning piston and cylinder assemblies 30 and 32 by receiving pressurized fluid from line 62, thereby causing fluid to be exhausted from the piston and cylinder assemblies 30 and 32 through line 60 and valve 64 to the reservoir 70. Such retraction of the piston and cylinder assemblies 30 and 32 narrows the separation between the forks of the fork-positioning load handler 10, 28. Conversely, the operator's upward movement of the spool of valve 64 while closing switch 64*b* conducts pressurized fluid through line 60 to extend the piston and cylinder assemblies 30 and 32 to widen the separation between the forks, while fluid is exhausted through line 82, valve 76, line 62 and valve 64 to the reservoir 70.

Since the battery 84 is independent of the lift truck electrical system, the battery, solenoid coil and other control system components can be standardized to a single, uniform voltage, such as twelve volts, for any type of lift truck, regardless of its electrical system.

Preferably, solenoid valve 76, transceiver 80, and their independent battery power source 84 are highly compact units mountable in the limited space available within the load handler. Minimizing the size of these components minimizes the fore and aft horizontal dimensions of the load handler, thereby maximizing the load-carrying capacity of the counterbalanced lift truck upon which it is mounted by keeping the center of gravity of the load as far rearward as is possible. For example, these components can be mounted as a module on the top of the lower transverse member 16*a* of the carriage 10 so as to be side-shiftable, without increasing the fore and aft horizontal dimensions of the carriage.

The size of the solenoid valve 76 is minimized in the exemplary circuit of FIG. 8 by requiring the valve to conduct only the flow to and from line 62, and not line 60 which bypasses the valve 76 even though it exercises as much control over the movements of fork-positioning cylinders 30 and 32 as does line 62. Minimizing the volumetric flow capacity of valve 76 in this manner not only minimizes its size, but also minimizes the power consumption of solenoid 76*a*, which in turn minimizes the size requirements for the independent battery 84 mounted on the load handler by limiting its energy storage requirement.

The safety of the control system is maximized in one or more of three different ways. First, the use of the pair of transceivers, which can transmit their identity codes to each other to authenticate each other's identity, guards against the possibility that stray radio signals from an unauthorized transmitter, perhaps on a nearby second lift truck, might erroneously actuate the solenoid valve 76 of the lift truck and cause the inadvertent actuation of an unintended hydraulic function such as movement of the fork-positioning cylinders while a load is supported or, more dangerous, opening of clamp arms while supporting a load. Second, the provision of two-way communication between the pair of transceivers enables an improperly-functioning actuator, valve or other component, or any other unsafe condition, to be identified by one or more sensors 81 (FIG. 8) mounted on the load handler and powered by the battery 84, and transmitted wirelessly by transceiver 80 to transceiver 78 and then to a central processor on the lift truck for automatic corrective action, or interruption of any action, as appropriate. The third way in which the control system maximizes safety is to make the solenoid valve 76 spring biased to a normal, or "default," position which causes actuation of the particular hydraulic function least likely to create a hazard if the function were inadvertently actuated (in this case the side-shifting cylinder 24).

Figure 9:
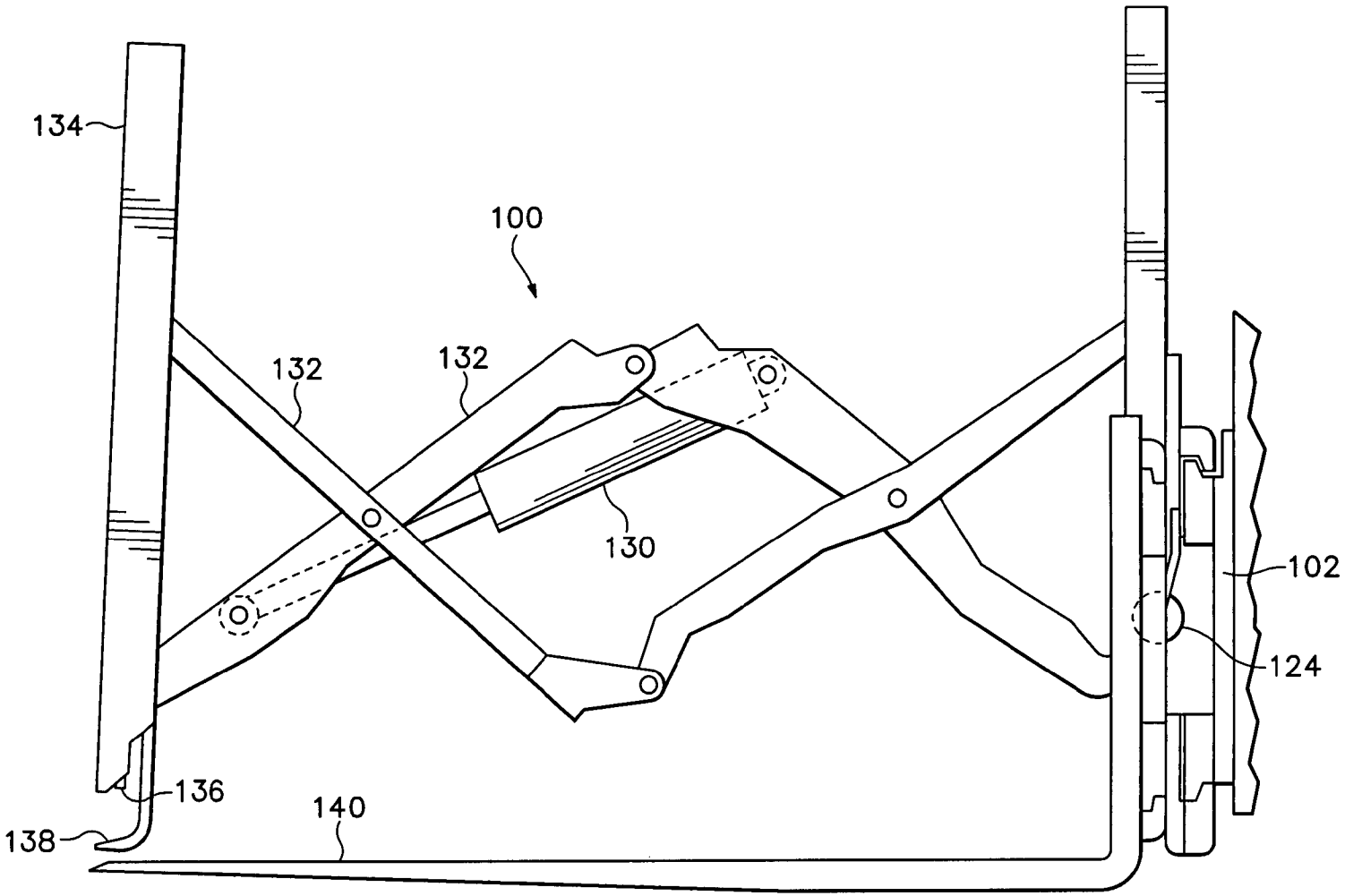
FIG. 9 is a side view of a second load-handler embodiment showing an exemplary side-shifting load push-pull assembly.
Figure 10:
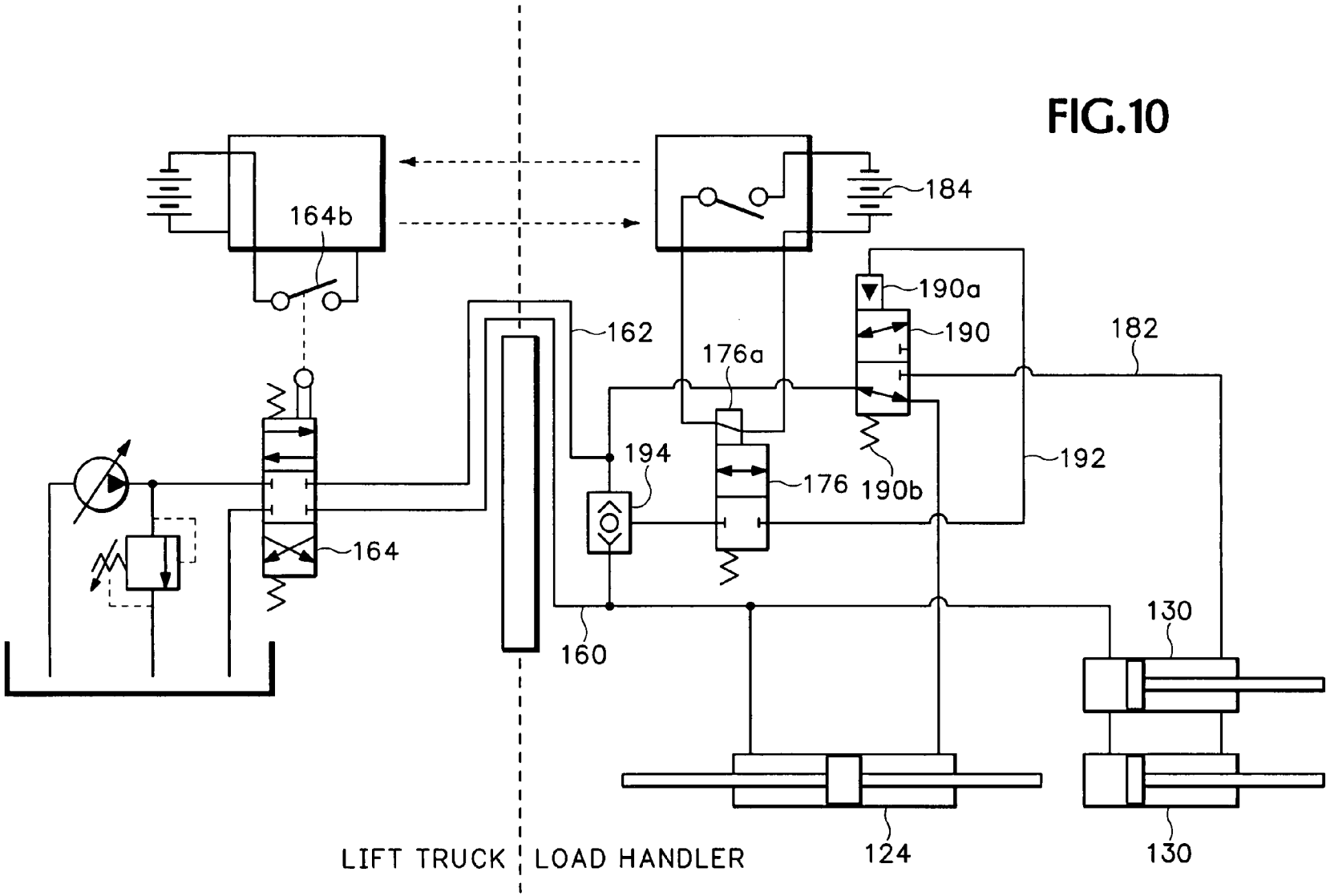
FIG. 10 is a simplified schematic circuit diagram of another exemplary embodiment of a wireless hydraulic control system.

FIG. 9 shows an alternative type of load handler which can likewise be controlled by the wireless control system of FIG. 8 or, more preferably, by the wireless control system of FIG. 10. FIG. 9 shows a conventional push-pull type of load handler 100 having a side-shifting carriage 102 movable transversely by a side-shifting piston and cylinder assembly 124 as a first hydraulic function. A second hydraulic function is provided by a pair of large piston and cylinder assemblies 130 which selectively extend and retract a parallelogram-type linkage 132 which in turn selectively pushes a load-engaging frame 134 forwardly and retracts it rearwardly. A hydraulically-actuated slip sheet clamp 136, 138 is hydraulically synchronized with the cylinder assemblies 130 so that a load supported by a slip sheet can be pulled rearwardly onto a supporting platen or forks 140.

An exemplary wireless control circuit shown in FIG. 10, similar in many respects to the circuit of FIG. 8, is adapted to operate the push-pull load handler of FIG. 9. The principal difference between the circuit of FIG. 10 and the circuit of FIG. 8, other than the directions of extension of the piston and cylinder assemblies 130, is the transformation of the solenoid valve 176 from a primary flow selector valve to a pilot pressure control valve, which in turn controls a pilot pressure-operated primary flow selector control valve 190. The two valves cooperate together to form a solenoid-operated hydraulic selector valve assembly corresponding to the valve assembly 76 of FIG. 8. With both valve 176 and valve 190 in their spring-biased "default" positions, the operator can control the side-shifting piston and cylinder assembly 124 by movement of his manual control valve 164 without closure of switch 164*b* due to the communication of the side-shifting piston and cylinder assembly 124 with conduits 162 and 160, in the same manner described with respect to FIG. 8. However, when the operator closes switch 164*b* when moving the valve 164 in one direction or the other, the solenoid 176*a* is actuated in the manner previously described, thereby moving the spool of valve 176 downward so that pilot line 192 is exposed to the pressure in either line 162 or line 160 (depending upon which direction valve 164 has moved) through shuttle valve 194. This provides a low-volume pressurized pilot flow through valve 176 and line 192 to the pressure actuator 190*a* of the valve 190, moving its spool downwardly against spring 190*b* and enabling push-pull cylinders 130 to communicate through line 182 and valve 190 with line 162. Depending upon which direction the operator has moved valve 164, push-pull cylinders will be extended or retracted due to the receipt and exhaust of fluid through the appropriate lines 182 and 160. The principal benefit of this arrangement is that the solenoid 176*a* does not demand a high-energy drain from the independent battery power source 184 because the valve 176 is merely a small low-flow pilot valve. The relatively large volumetric flow rates required by the large cylinders 130 are satisfied by the larger pilot-operated valve 190, which does not itself require battery power.

The pilot-controlled feature of FIG. 10 would also be preferable in the circuit of FIG. 8 if such circuit, instead of controlling low-volume fork-positioning cylinders 30 and 32, controlled a pair of larger cylinders for closing and opening parallel sliding clamp arms, because of their higher volumetric flow requirements.

Figure 11:
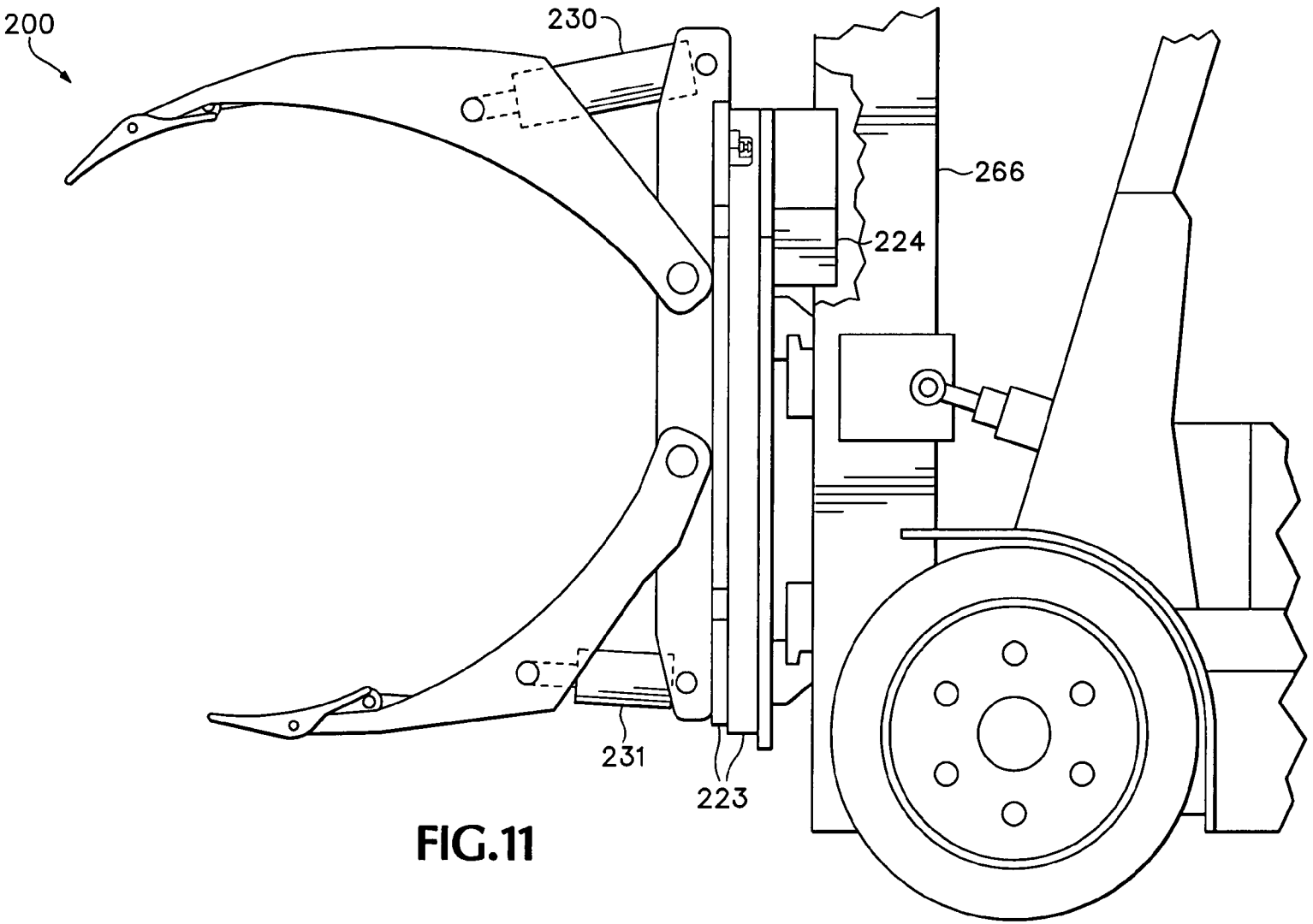
FIG. 11 is a side view of a third load-handler embodiment showing an exemplary pivoted arm clamp with both rotational and lateral positioning control.

Pivoted arm clamps, such as the load handler 200 shown mounted on a lift truck mast 266 in FIG. 11, could also benefit from a pilot-operated wireless control system similar to that of FIG. 10. Pivoted arm clamps usually have a first hydraulic function in the form of a rotator 223 which rotates the clamp bidirectionally about a longitudinal axis in response to a bidirectional hydraulic motor 224. A second hydraulic function is a large pair of piston and cylinder assemblies 230 which clamp and unclamp cylindrical objects such as large paper rolls. In some of these clamps, the clamp arm not actuated by the cylinders 230 is fixed, while in other clamps it is separately movable for transverse load-positioning purposes by yet another pair of piston and cylinder assemblies 231 which create a third hydraulic function.

Figure 12:
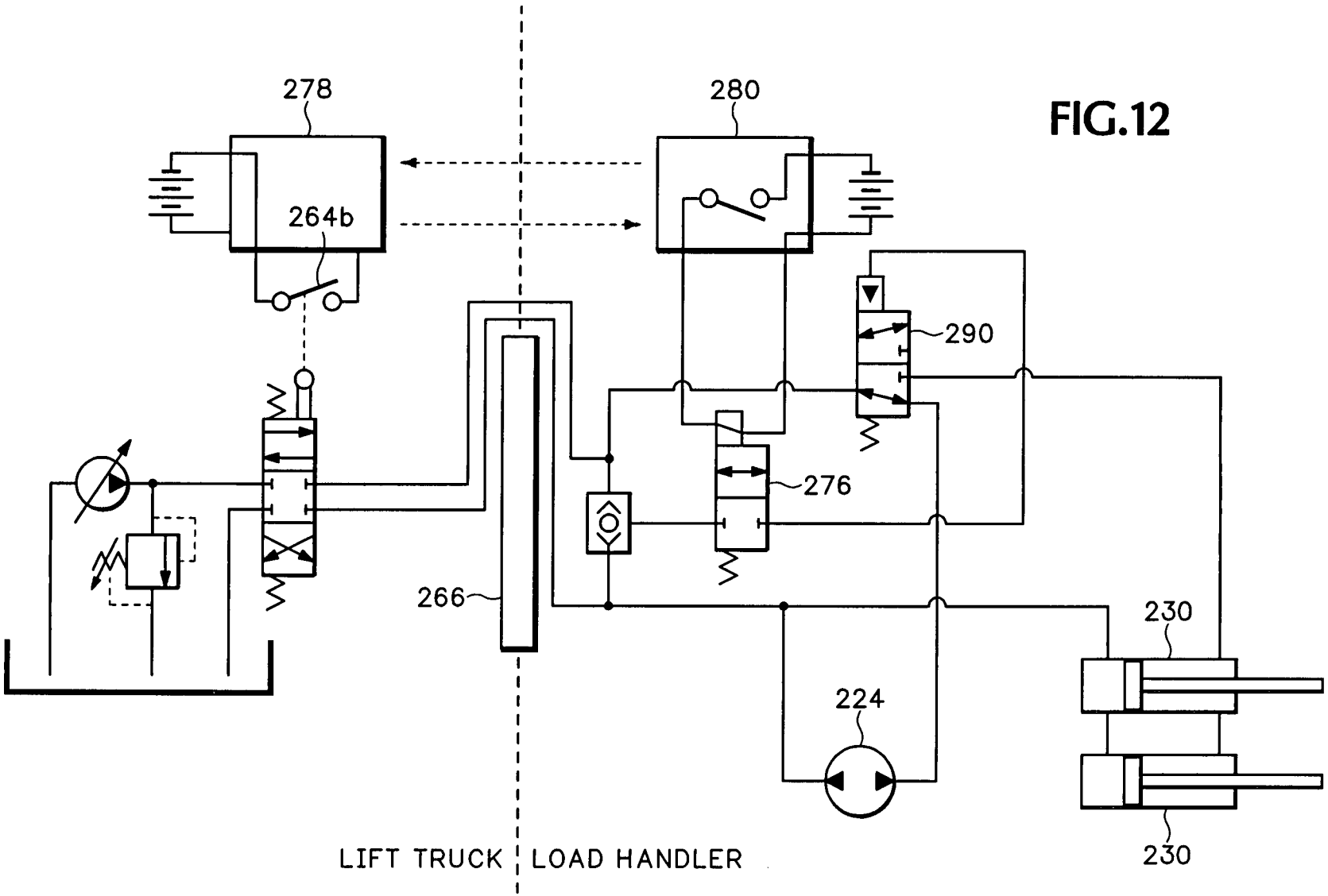
FIG. 12 is a simplified schematic circuit diagram of another exemplary embodiment of a wireless hydraulic control system, adapted for the pivoted arm clamp of FIG. 11.

FIG. 12 depicts a pilot-operated exemplary circuit, operationally the same as that of FIG. 10, for wireless control of a two-function pivoted arm clamp having a rotator motor 224 and the pair of clamping cylinders 230 shown in FIG. 11. If a third hydraulic function, such as that of cylinders 231, were also included, a second pilot-operated valve assembly similar to the combination of valves 276 and 290 would be provided for control of piston and cylinder assemblies 231, together with a second pair of transceivers such as 278 and 280, and a second operator-controlled electrical switch 264*b*.

Although wireless communication by radio signals is preferred for all of the embodiments of the control system, wireless communication by optical, sonic or other wireless means is also within the scope of the invention.

Moreover, although the transmitting function of the transceiver 80 has been described principally with respect to safety-related signals, other types of wireless signals can alternatively be transmitted from the transceiver 80, or other transmitter mounted on the load handler, to the transceiver 78 or other receiver mounted on the lift truck. For example, these signals could relate in other ways to manual or automatic control by the lift truck of one or more hydraulic actuators on the load handler, in response to measurements by one or more mechanical, optical or ultrasonic sensors 81 (FIG. 8), indicating: (1) dimensions, shape, presence or position of the load to synchronize or otherwise control extension or retraction of an actuator; or (2) load weight or slip to control the load-clamping force of an actuator; or (3) actuator pressure, position or diagnostics for actuator control by feedback or for actuator or sensor disablement for electrical power conservation purposes. These signals could be received by the operator, or by a central processor on the lift truck which provides automatic control in response to the signals.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A load handler mountable movably on a mast of an industrial lift truck, said load handler comprising:

(a) at least a first hydraulic actuator capable of performing a first function in response to pressurized hydraulic fluid received from said lift truck, and a second hydraulic actuator capable of performing a second function in response to said pressurized hydraulic fluid, said first and second hydraulic actuators being movable independently of each other in response to said pressurized hydraulic fluid;

(b). a solenoid-operated hydraulic selector valve assembly mounted on said load handler capable of moving between a first position, causing said pressurized hydraulic fluid to move said first hydraulic actuator, and a second position, causing said pressurized hydraulic fluid to move said second hydraulic actuator;

(c). an electrical power source electrically independent of said lift truck mounted on said load handler and capable of supplying electrical power to said solenoid-operated hydraulic selector valve assembly effective to cause said pressurized hydraulic fluid to move said hydraulic actuators;

(d). an electrical receiver mounted on said load handler capable of receiving first wireless signal transmissions and capable of selectively controlling said electrical power supplied from said power source to said solenoid-operated hydraulic selector valve assembly in response to said first wireless signal transmissions; and (e). an electrical transmitter mounted on said load handler powered by a battery of said electrical power source capable of generating second wireless signal transmissions adapted to identify a malfunction of said load handler and to control at least one of said hydraulic actuators in response to said malfunction.

2. The load handler of claim 1 wherein said second wireless signal transmissions are adapted to uniquely identify said transmitter.

3. The load handler of claim 1 wherein said second wireless signal transmissions are adapted to control at least one of said hydraulic actuators in response to a sensor mounted on said load handler.

4. The load handler of claim 3 wherein said sensor measures an amount of electrical power available from said electrical power source.

5. The load handler of claim 1 wherein said second wireless signal transmissions are adapted to identify a malfunction of said solenoid-operated hydraulic selector valve.

6. The load handler of claim 1 wherein said second wireless signal transmissions are adapted to identify a characteristic of a load.

7. The load handler of claim 1 wherein said second wireless signal transmissions are adapted to identify a position of a load.

8. The load handler of claim 1 wherein said second wireless signal transmissions are adapted to identify an operating condition of said load handler.

9. The load handler of claim 1 wherein at least one of said hydraulic actuators is bidirectional and receives and exhausts hydraulic fluid through a pair of conduits, said solenoid-operated hydraulic selector valve assembly being interposed in one of said pair of conduits, the other of said pair of conduits bypassing said valve assembly.

10. The load handler of claim 1 wherein said solenoid-operated hydraulic selector valve assembly includes a solenoid-operated pilot pressure control valve selectively movable in response to said first wireless signal transmissions between a first position adapted to provide a pilot pressure and a second position adapted to prevent said pilot pressure, said valve assembly further comprising a pilot pressure-operated valve capable of moving between a first position causing said pressurized hydraulic fluid to move said first hydraulic actuator, and a second position causing said pressurized hydraulic fluid to move said second hydraulic actuator, in response to control of said pilot pressure by said pilot pressure control valve.

11. The load handler of claim 1 wherein said selector valve assembly is spring-biased to one of said first and second positions.

12. The load handler of claim 1 wherein said selector valve assembly is spring-biased toward the one of said first and second positions least likely to cause a hazard by movement of its corresponding actuator.

13. The load handler of claim 1 wherein said electrical receiver is adapted to receive said first wireless signal transmissions originating from a transmitter located on said lift truck.

14. The load handler of claim 1, wherein said load handler is capable of operating hydraulically in fluid communication with said lift truck via no more than two hydraulic conduits and without any wired electrical power connection between said solenoid-operated hydraulic selector valve assembly and said lift truck.

15. A load handler mountable movably on a mast of an industrial lift truck, said load handler comprising:

(a) at least a first hydraulic actuator capable of performing a first function in response to pressurized hydraulic fluid received from said lift truck, and a second hydraulic actuator capable of performing a second function in response to said pressurized hydraulic fluid, said first and second hydraulic actuators being movable independently of each other in response to said pressurized hydraulic fluid;

(b). a solenoid-operated hydraulic selector valve assembly including a solenoid-operated pilot pressure control valve mounted on said load handler, powered by a battery electrically independent of said lift truck mounted on said load handler and capable of supplying electrical power to said pilot pressure control valve effective to cause said control valve to move between a first position providing a pilot pressure and a second position preventing said pilot pressure, and further including a pilot pressure-operated selector valve mounted on said load handler capable of moving between a first position causing said pressurized hydraulic fluid to move said first hydraulic actuator, and a second position causing said pressurized hydraulic fluid to move said second hydraulic actuator, in response to control of said pilot pressure by said pilot pressure control valve; and (c). an electrical receiver mounted on said load handler capable of receiving first wireless signal transmissions and selectively controlling electrical power supplied from said battery to said solenoid-operated pilot pressure control valve in response to said first wireless signal transmissions.

16. The load handler of claim 15 wherein at least one of said hydraulic actuators is bidirectional and receives and exhausts hydraulic fluid through a pair of conduits, said solenoid-operated hydraulic selector valve assembly being interposed in one of said pair of conduits, the other of said pair of conduits bypassing said valve assembly.

17. The load handler of claim 15 wherein said electrical receiver is adapted to receive said first wireless signal transmissions originating from a transmitter located on said lift truck.

18. The load handler of claim 15 wherein said load handler is capable of operating hydraulically in fluid communication with said lift truck via no more than two hydraulic conduits and without any wired electrical power connection between said solenoid-operated hydraulic selector valve assembly and said lift truck.

* * * * *